US010590589B2

(12) United States Patent
Pollett

(10) Patent No.: US 10,590,589 B2
(45) Date of Patent: Mar. 17, 2020

(54) SPRAY HOSE ASSEMBLY FOR A WASHING MACHINE APPLIANCE

(71) Applicant: General Electric Company, Schenectady, NY (US)

(72) Inventor: James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 905 days.

(21) Appl. No.: 14/703,929

(22) Filed: May 5, 2015

(65) Prior Publication Data

US 2016/0326685 A1 Nov. 10, 2016

(51) Int. Cl.
*D06F 39/08* (2006.01)

(52) U.S. Cl.
CPC ..... *D06F 39/088* (2013.01)

(58) Field of Classification Search
CPC ..... D06F 39/086
See application file for complete search history.

(56) References Cited

U.S. PATENT DOCUMENTS 2,584,943 A * 2/1952 Thomas ..... D06F 87/00 239/458
5,713,222 A 2/1998 Johnson
2002/0134117 A1* 9/2002 Arai ..... D06F 19/00 68/3 SS
2003/0233711 A1* 12/2003 Marsh ..... D06F 39/088 8/158
2007/0084000 A1* 4/2007 Bernardino ..... D06F 39/02 8/158

FOREIGN PATENT DOCUMENTS

CN 103820967 A 5/2014

* cited by examiner

*Primary Examiner* — Spencer E Bell
(74) *Attorney, Agent, or Firm* — Dority & Manning, P.A.

(57) ABSTRACT

A spray hose assembly for a washing machine appliance is provided. The spray hose assembly includes a hose assembly fluidly connecting a spray nozzle and an outlet of a fluid source valve. The fluid source valve additionally includes a first attachment end and a second attachment end. The first and second attachment ends of the fluid source valve are configured to be fluidly connected between a water source and a supply line of the washing machine appliance such that the water source valve may provide a flow of water to the spray hose assembly without preventing the washing machine appliance from maintaining fluid connection with the water source.

19 Claims, 4 Drawing Sheets

SPRAY HOSE ASSEMBLY FOR A WASHING MACHINE APPLIANCE

FIELD OF THE INVENTION

The present disclosure relates generally to accessories for washing machine appliances.

BACKGROUND OF THE INVENTION

Washing machine appliances generally include a tub for containing wash fluid, e.g., water and detergent, bleach, and/or other fluid additives. A basket is rotatably mounted within the tub and defines a wash chamber for receipt of articles for washing. During operation of such washing machine appliances, wash fluid is directed into the tub and onto articles within the wash chamber of the basket. The basket and/or an agitation element can rotate at various speeds to, e.g., agitate articles within the wash chamber, wring wash fluid from articles within the wash chamber, etc.

Fluid additives may be provided to the wash fluid via a dispenser cup. For example, a user may pour a predetermined amount of detergent, fabric softener, or bleach into the dispenser cup, which may then be provided to the tub, wash basket, or both during operation of the washing machine appliance. The detergent, fabric softener, or bleach may be transported from a source through a cap included in the packaging of such detergent, fabric softener, or bleach. However, through continuous use, the dispenser cup and/or cap may build up an undesirable amount of residue from one or more of the fluid additives. The user may be required to remove the dispenser cup, transport the dispenser cup and/or cap to, e.g., a kitchen sink, and manually wash the dispenser cup and/or cap in order to remove the undesired residue.

Moreover, in certain situations, the user may have an article to be washed with one or more stains requiring pretreatment activities before washing in the washing machine appliance. Such pretreatment activities can include, e.g., wetting the article, scrubbing the article, etc. Accordingly, the user may again be required to transport the article to, e.g., a kitchen sink, in order to perform certain of the pretreatment activities on the article.

Accordingly, an attachment feature for a washing machine appliance that allows a user to rinse out the dispenser cup and/or cap at the washing machine appliance would be useful. Further, an attachment feature for a washing machine appliance that allows a user to conveniently perform certain pretreatment activities on one or more articles to be washed by the washing machine appliance would be particularly beneficial.

BRIEF DESCRIPTION OF THE INVENTION

Aspects and advantages of the invention are set forth below in the following description, or may be obvious from the description, or may be learned through practice of the invention.

In accordance with one embodiment of the present disclosure, a spray hose assembly for a washing machine appliance is provided. The spray hose assembly includes a hose assembly extending between a first end and a second end for directing a flow of liquid. The spray hose assembly additionally includes a liquid spray nozzle fluidly connected to the hose assembly at the first end and a fluid source valve. The fluid source valve includes an outlet fluidly connected to the hose assembly at the second end of the hose assembly. The fluid source valve further including a first attachment end and a second attachment end for fluidly connecting the spray hose assembly to a fluid source of the washing machine appliance.

In accordance with another embodiment of the present disclosure, a washing machine appliance is provided. The washing machine appliance includes a cabinet, a tub positioned within the cabinet, and a basket rotatably mounted within the tub. The basket defines a wash chamber for receipt of articles for washing. The washing machine appliance additionally includes a supply line for fluidly connecting a spout of the washing machine appliance to a water source and a spray hose assembly. The spray hose assembly includes a hose assembly extending between a first end and a second end, a water nozzle fluidly connected to the hose assembly at the first end, and a water source valve. The water source valve includes an outlet fluidly connected to the hose assembly at the second end of the hose assembly, a first attachment end, and a second attachment end. The first attachment end is fluidly connected to the water source and the second attachment end is fluidly connected to the supply line such that the water source is configured to provide water to the hose assembly and the supply line.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
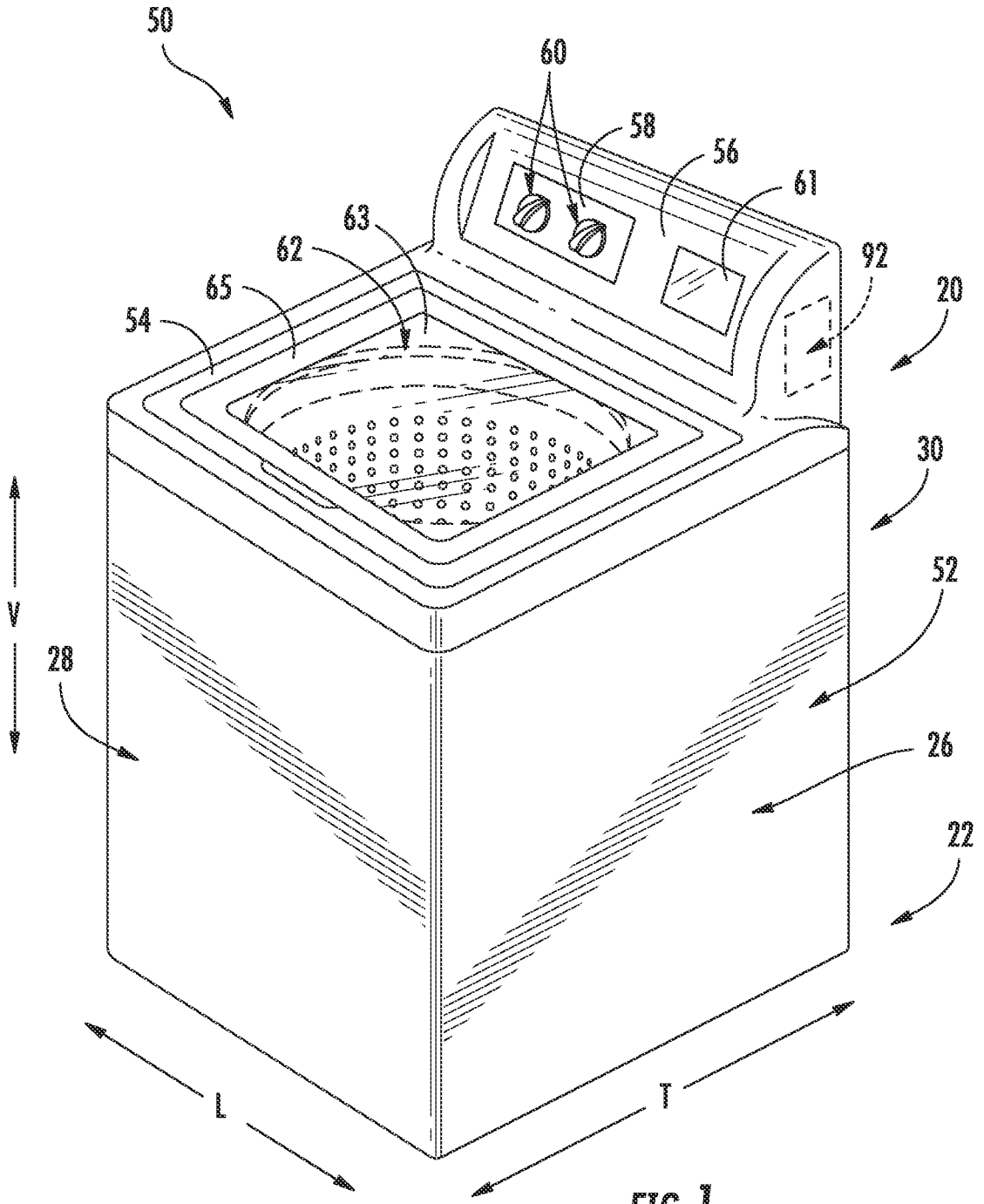
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52, the cabinet 52 including a cover 54 and a backsplash 56. Backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other potential items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Lid 62 in the exemplary embodiment depicted includes a transparent panel 63, which may be formed of, for example, glass, plastic, or any other suitable material. The transparency of the panel 63 allows users to see through the panel 63, and into the tub 64 when the lid 62 is in the closed position. In certain embodiments, the panel 63 may itself generally form the lid 62. However, in other embodiments, lid 62 may include the panel 63 and a frame 65 surrounding and encasing the panel 63. Additionally, or alternatively, in still other embodiments panel 63 may not be transparent.

The washing machine appliance 50 depicted in FIG. 1 defines a vertical direction V, a lateral direction L, and a transverse direction T. The vertical, lateral, and transverse directions V, L, T defined by washing machine appliance 50 are mutually perpendicular and together define an orthogonal direction system. Moreover, referring still to FIG. 1, the exemplary washing machine appliance 50 depicted extends generally along the vertical direction V between a top end 20 and a bottom end 22, along the lateral direction L between a first side 24 (see FIG. 2) and a second side 26, and along the transverse direction T between a front side 28 and a rear side 30.

Figure 2:
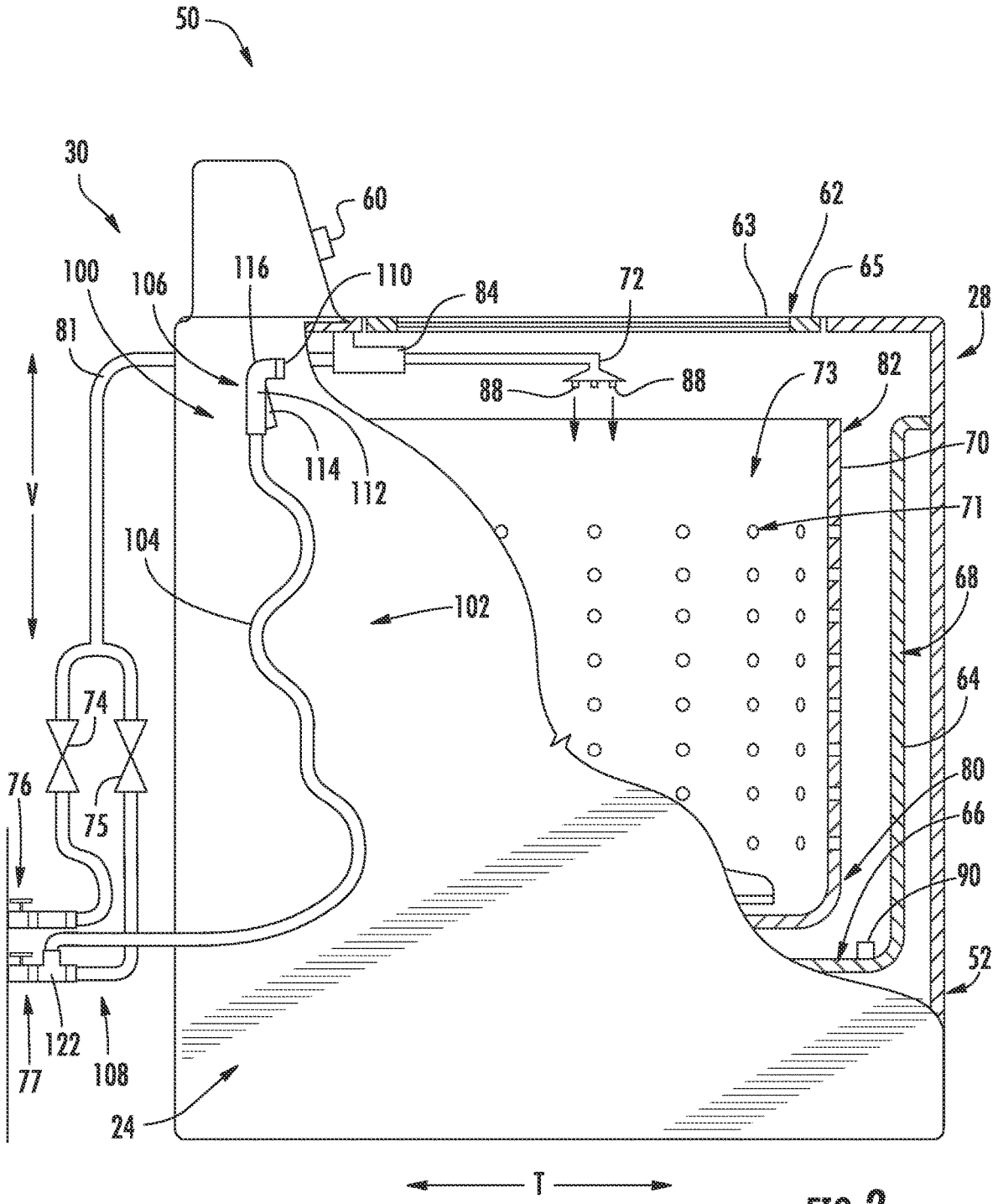
FIG. 2 provides a side, cutaway view of the exemplary washing machine appliance of FIG. 1 including a spray hose assembly in accordance with an exemplary embodiment of the present disclosure.

Referring now to FIG. 2, a side cutaway view is provided of the exemplary washing machine appliance 50 of FIG. 1 including a spray hose assembly in accordance with an exemplary embodiment of the present disclosure.

As may be seen in FIG. 2, the tub 64 is positioned within the cabinet 52 and includes a bottom wall 66 and a sidewall 68. A wash drum or wash basket 70 is rotatably mounted within tub 64. In particular, basket 70 is rotatable about the vertical direction V. Thus, washing machine appliance 50 is generally referred to as a "vertical axis washing machine appliance." Basket 70 defines a wash chamber 73 for receipt of articles for washing and extends, e.g., between a bottom portion 80 and a top portion 82 along the vertical direction V. Additionally, basket 70 includes a plurality of openings or perforations 71 therein to facilitate fluid communication between an interior of basket 70 and tub 64.

A spout 72 is configured for flowing a liquid into one or both of tub 64 and basket 70. In particular, spout 72 may be positioned at or adjacent to top portion 82 of basket 70. Spout 72 may be in fluid communication with a water source, or more specifically to a hot water source 76 and a cold water source 77, in order to direct liquid (e.g., water) into tub 64 and/or onto articles within chamber 73 of basket 70. Spout 72 may further include apertures 88 through which water may be sprayed into the tub 64. Apertures 88 may, for example, be tubes extending from the spout 72, as illustrated, or alternatively may simply be holes defined in the spout 72. However, in other embodiments, apertures 88 may be any other suitable openings through which water may be sprayed. Further, spout 72 may additionally include other openings, holes, etc. (not shown) through which water may be flowed, i.e., sprayed or poured, into the tub 64 and/or basket 70.

Various valves may regulate the flow of fluid through spout 72 via a supply line 81. For example, a hot water valve 74 and a cold water valve 75 may be positioned in supply line 81 to flow hot water and cold water, respectively, through the supply line 81. It should be appreciated that as used herein, the term "supply line" is used to refer generally to the one or more fluid lines, pipes, conduits, etc. provided between water sources 76, 77 and spout 72 of washing machine appliance 50.

Referring still to FIG. 2, each valve 74, 75 may be selectively adjusted between an open position allowing a flow of fluid therethrough to spout 72 and a closed position terminating or obstructing the flow of fluid therethrough to spout 72. Hot water valve 74 may be in fluid communication with hot water source 76, which may be external to the washing machine appliance 50. Similarly, cold water valve 75 may be in fluid communication with cold water source 77, which may also be external to the washing machine appliance 50. The cold water source 77 may, for example, be a commercial water supply, while the hot water source 76 may be, for example, a water heater appliance. Such water sources 76, 77 may supply water to the appliance 50 through the respective valves 74, 75 and supply line 81. Although the valves 74, 75 are depicted for the embodiment of FIG. 2 positioned outside the cabinet 52, in other exemplary embodiments, one or both of the valves 74, 75 may instead be positioned within the cabinet 52.

An additive dispenser, or dispenser cup, 84 is additionally provided for directing a fluid additive, such as detergent, bleach, liquid fabric softener, etc., into tub 64. For the embodiment depicted, the dispenser 84 is in fluid communication with spout 72 such that water flowing from supply line 81 to spout 72 flows through dispenser 84, mixing with the fluid additive at a desired time during operation to form a liquid or wash fluid, before being flowed into tub 64. The spout 72 depicted is a separate downstream component from dispenser 84. In other embodiments, however, spout 72 and dispenser 84 may be integral, with a portion of dispenser 84 serving as the spout 72. Alternatively still, spout 72 and dispenser 84 may be separate components defining parallel flow paths from supply line 81 into tub 64 and/or basket 70. A pump assembly (not shown) is located beneath tub 64 and basket 70 for gravity assisted flow to drain tub 64.

Various sensors may additionally be included in the washing machine appliance 50. For example, a pressure sensor 90 may be positioned in the tub 64 as illustrated. Any suitable pressure sensor 90, such as an electronic sensor, a manometer, or another suitable gauge or sensor, may be utilized. The pressure sensor 90 may generally measure the pressure of water in the tub 64. This pressure can then be utilized to estimate the height or level of water in the tub 64. Additionally, a suitable speed sensor (not shown) can be provided to measure rotational speed of basket 70. Other suitable sensors, such as temperature sensors, etc., may additionally be provided in the washing machine appliance 50.

Operation of washing machine appliance 50 is controlled by a processing device or controller 92 (shown in phantom in FIG. 1), that is operatively coupled to the input selectors 60 located on washing machine backsplash 56 for user manipulation to select washing machine cycles and features. Controller 92 may further be operatively coupled to various other components of appliance 50, such as valves 74, 75, pressure sensor 90, and other suitable sensors, etc. In response to user manipulation of the input selectors 60, controller 92 may operate the various components of washing machine appliance 50 to execute selected machine cycles and features.

Controller 92 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 92 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 92 via one or more signal lines or shared communication busses.

It should be appreciated, however, that while described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
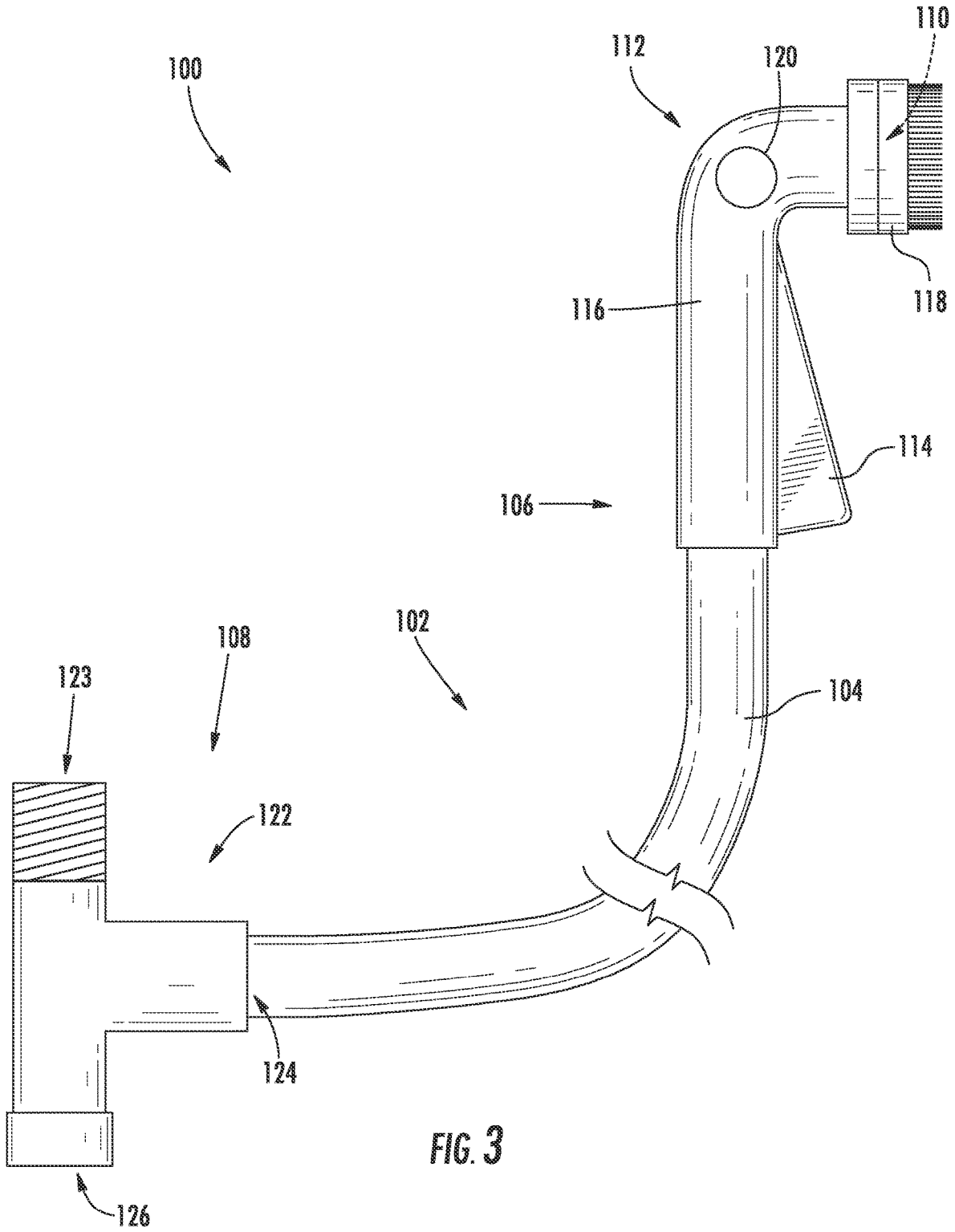
FIG. 3 provides a side view of the exemplary spray hose assembly of FIG. 2.

Referring still to FIG. 2 and now also to FIG. 3, a spray hose assembly 100 in accordance with an exemplary embodiment of the present disclosure depicted. FIG. 2 provides a side view of the spray hose assembly 100 included with the washing machine appliance 50 and fluidly connected to a water source of the washing machine appliance 50, and FIG. 3 provides a side view of the spray hose assembly 100 individually.

The exemplary spray hose assembly 100 includes a hose assembly 102, which for the exemplary embodiment depicted includes a single flexible hose 104, extending between a first end 106 and a second end 108 for directing a flow of liquid. The hose 104 may be formed of any suitable material, such as a rubber or other material suitable for forming a fluid hose. Additionally, spray hose assembly 100 includes a liquid spray nozzle 110, or water spray nozzle, fluidly connected to the hose assembly 102 at the first end 106. More particularly, the exemplary spray hose assembly 100 depicted includes a handle 112 positioned at the first end 106 of the hose assembly 102, the handle 112 including the liquid spray nozzle 110.

As may be seen more clearly in FIG. 3, the handle 112 additionally includes an activation member 114, or trigger. The activation member 114 is configured to selectively allow a flow of liquid from the hose assembly 102 through the liquid spray nozzle 110. Further, the liquid spray nozzle 110 is configured to direct such flow of water in a desired direction. For example, in certain exemplary embodiments a user may depress the activation member 114 into a body 116 of the handle 112, activating an internal valve (not shown) to allow a flow of liquid therethrough to the liquid spray nozzle 110.

Additionally, the handle 112 of the spray hose assembly 100 of FIGS. 2 and 3 includes an attachment member 118, the attachment member 118 removably attached to handle 112 over nozzle 110. More particularly, for the embodiment of FIGS. 2 and 3, the attachment member 118 is a brush attachment removably attached to handle 112 over nozzle 110. The attachment member 118 may be removably attached to handle 112 in any suitable manner. For example, attachment member 118 may utilize a rotationally and axially engaging attachment mechanism, such as with corresponding threaded components, or alternatively may use a suitable quick-release attachment configuration. Spray hose assembly 100 including the brush attachment removably attached to handle 112 over nozzle 110 may assist a user in, e.g., one or more pretreatment activities of articles for washing including undesired stains or marks.

It should be appreciated, however, that in other embodiments, any other suitable attachment member 118 may be provided. For example, in other embodiments, attachment member 118 may be a spray tip, such as a flat spray tip, a concentrated flow spray tip, or shower-type spray tip. Moreover, in still other embodiments, the attachment member 118 may include a plurality of spray tips selectively accessible by, e.g., rotating a portion of such attachment member 118. Further, although handle 112 defines a generally bent shape in the embodiment depicted in FIGS. 2 and 3, in other exemplary embodiments, handle 112 may instead define any other suitable shape, such as a linear shape.

Moreover, for the embodiment depicted, the handle 112 additionally includes a mounting feature 120 to allow a user to, e.g., mount the handle 112 of the spray hose assembly 100 on the cabinet 52 of the washing machine appliance 50. In particular embodiments, the mounting feature 120 may be a magnet for removably attaching the handle 112 to any ferrous object, such as the cabinet 52 of the wash machine appliance 50. However, in other exemplary embodiments, any other suitable mounting feature 120 may be included for mounting the handle 112 of the exemplary spray hose assembly 100.

Referring still to FIGS. 2 and 3, the spray hose assembly 100 additionally includes a fluid source valve 122 including an outlet 124 fluidly connected to the hose 104 of the hose assembly 102 at the second end 108 of the hose assembly 102. In certain embodiments, the flexible hose 104 may be positioned within the outlet 124 and attached using a suitable glue or other epoxy. Alternatively, the flexible hose 104 may be positioned over the outlet 124 of the fluid source valve 122 and crimped onto the outlet 124 of the fluid source valve 122. However, in still other embodiments, any suitable means may be utilized for fluidly connecting the flexible hose 104 to the outlet 124 of the fluid source valve 122.

The fluid source valve 122 depicted is configured as a T-shaped valve additionally including a first attachment end 126 and a second attachment end 128. The first and second attachment ends 126, 128 are fluidly connected between the supply line 81 and the water source 77 for fluidly connecting the spray hose assembly 100 to the fluid source 77. More particularly, for the embodiment depicted, the first attachment end 126 of the fluid source valve 122 is a male attachment end the second attachment end 128 of the fluid source valve 122 is a female attachment end. Additionally, as is shown in FIG. 2, the first attachment end 126 may be fluidly attached directly to the cold water source 77 and the second attachment end 128 may be fluidly attached directly to the supply line 81 of the washing machine appliance 50. Accordingly, with such a configuration, the spray hose assembly 100 may be easily connected to a water source of the washing machine appliance 50 without requiring any additional hardware, and without disrupting the supply line's 81 fluid connection to the water source.

As used herein, the term "male attachment end" refers to a cylindrical portion of the valve having an outer surface defining a plurality of threads and "female attachment end" refers to a cylindrical portion of a valve having an inner surface defining a similar plurality of threads. Generally, a male attachment end may be attached to a female attachment end by inserting the male attachment end into the female attachment end and rotating the two parts relative to one another such that the corresponding threads engage with one another.

It should be appreciated, however, that in other exemplary embodiments, the fluid source valve 122 may be configured in any other suitable manner. For example, in other exemplary embodiments, the valve may be configured as a Y-shaped valve, and each of the first attachment end 126 and the second attachment end 128 may be male attachment ends. However, in an alternative exemplary embodiment, each of the first attachment end 126 and the second attachment end 128 may be female attachment ends. Moreover, although not depicted, in still other exemplary embodiments, the fluid source valve 122 may include additional or alternative structure not depicted or otherwise described herein.

Figure 4:
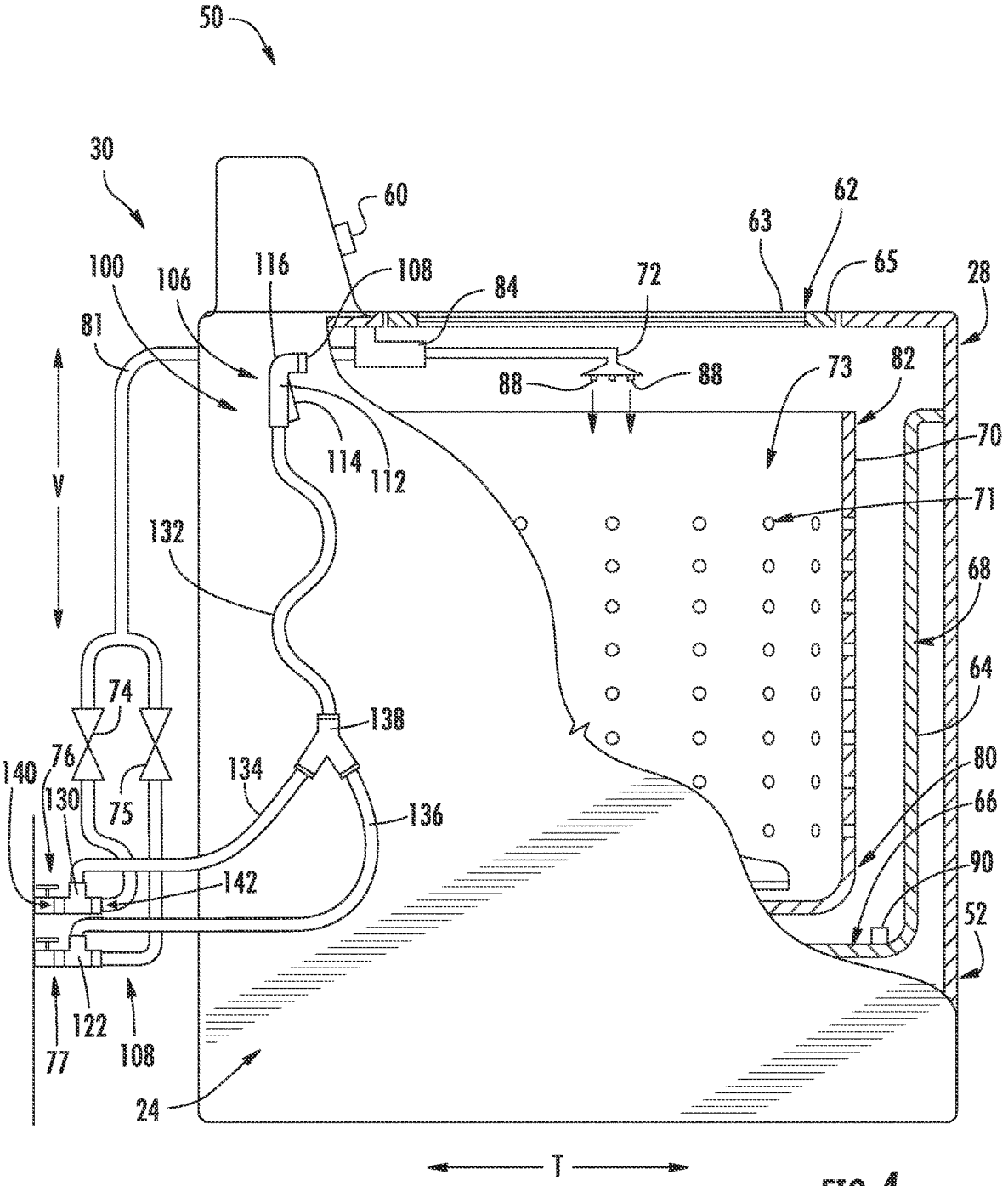
FIG. 4 provides a side, cutaway view of the exemplary washing machine appliance of FIG. 1 including a spray hose assembly in accordance with another exemplary embodiment of the present disclosure.

Referring now to FIG. 4, the exemplary washing machine appliance 50 of FIG. 1 is depicted including a spray hose assembly 100 in accordance with another exemplary embodiment of the present disclosure. The exemplary spray hose assembly 100 of FIG. 4 may be configured in substantially the same manner as the exemplary spray hose assembly 100 of FIG. 3. For example, the exemplary spray hose assembly 100 of FIG. 4 includes a hose assembly 102 extending between a first end 106 and a second end 108, and a liquid spray nozzle 110 fluidly connected to the spray hose assembly 100 at the first end 106. More particularly, the spray hose assembly 100 of FIG. 4 also includes a handle 112 positioned at the first end, the handle 112 including the liquid spray nozzle 110.

Additionally, the exemplary spray hose assembly 100 of FIG. 4 includes a fluid source valve 122 including an outlet 124, a first attachment end 126, and a second attachment end 128. However, for the exemplary embodiment depicted, the fluid source valve 122 is configured as a cold water source valve and the exemplary spray hose assembly 100 further includes a hot water source valve 130. Moreover, the exemplary hose assembly 102 of FIG. 4 includes a primary hose 132, a hot water hose 134, a cold water hose 136, and a three-way splitter valve 138. The three-way splitter valve 138 fluidly connects the primary hose 132, the hot water hose 134, and the cold water hose 136. For example, the three-way splitter valve 138 may be configured as a Y-shaped valve, a T-shaped valve, or any other suitable valve for fluidly connecting three hoses. As depicted, the cold water source valve (i.e., valve 122) is fluidly connected to the cold water hose 136 of the hose assembly 102 and the hot water source valve 130 is fluidly connected to the hot water hose 134 of the hose assembly 102.

As with the exemplary embodiment of FIG. 2, for the embodiment of FIG. 4, the first attachment end 126 of the cold water source valve (i.e., valve 122) is a male attachment end directly fluidly connected to the cold water source 77 and the second attachment end 128 of the cold water source valve is a female attachment end directly fluidly connected to the supply line 81. Similarly, the hot water source 130 valve also includes a first attachment end 140 and a second attachment end 142. The first attachment end 140 of the hot water source valve 130 is a male attachment end directly fluidly connected to the hot water source 76 and the second attachment end 142 of the hot water source valve 130 is a female attachment end directly fluidly connected to the supply line 81.

It should be appreciated, however, that in other exemplary embodiments, the first and second attachment ends 140, 142 of the hot water source valve 130 may alternatively have any other suitable configuration (e.g., female/male, male/male, or female/female, respectively). Additionally, or alternatively, the first attachment ends 126, 140 and second attachment ends 128, 142 of the cold water source valve 122 and/or of the hot water source valve 130 may alternatively define any other suitable attachment mechanism. For example, in certain exemplary embodiments, one or more of the first attachment ends 126, 140 and second attachment ends 128, 142 may include a quick release attachment mechanism.

A spray hose assembly 100 in accordance with one or more of the exemplary embodiments of the present disclosure may be attached to a washing machine appliance to allow a user to, e.g., conveniently wash out a dispenser and/or a cap of a wash additive source over a tub and a basket to remove any unwanted residue from wash additives contained therein. Moreover, a spray hose assembly 100 in accordance with one or more of the exemplary embodiments of the present disclosure may be easily attached to one or more water sources of a washing machine appliance to allow a user to, e.g., conveniently perform certain pretreatment activities on articles for washing without requiring any special hardware or modifications of the washing machine appliance. Notably, subsequent to utilizing a spray hose assembly 100 in accordance with an exemplary embodiment of the present disclosure, the user may evacuate the water dispensed via the spray hose assembly 100 from a wash chamber of a washing machine appliance using, e.g., a "drain/spin cycle" of the washing machine appliance. Alternatively, the water dispensed via the spray hose assembly 100 may not be evacuated from the wash chamber of the washing machine appliance, and instead may be utilized in a subsequent "wash cycle" of the washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spray hose assembly for a washing machine appliance comprising a supply line having a supply line valve, the spray hose assembly comprising:

a hose assembly extending between a first end and a second end for directing a flow of liquid;

a liquid spray nozzle fluidly connected to the hose assembly at the first end; and a fluid source valve including an outlet fluidly connected to the hose assembly at the second end of the hose assembly, the fluid source valve further including a first attachment end and a second attachment end, the first attachment end configured for fluid connection to a water source and the second attachment end configured for fluid connection to the supply line of the washing machine appliance at a location upstream of the supply line valve.

2. The spray hose assembly of claim 1, further comprising a handle positioned at the first end of the hose assembly, the handle including the liquid spray nozzle.

3. The spray hose assembly of claim 2, wherein the handle includes a magnet for removably attaching the handle to a ferrous object.

4. The spray hose assembly of claim 2, wherein the handle additionally includes an activation member, the activation member configured to selectively allow a flow of liquid from the hose assembly through the liquid spray nozzle.

5. The spray hose assembly of claim 1, wherein the first attachment end of the fluid source valve is a male attachment end, and wherein the second attachment end of the fluid source valve is a female attachment end.

6. The spray hose assembly of claim 1, wherein the first attachment end and the second attachment end of the fluid source valve are each male attachment ends.

7. The spray hose assembly of claim 1, wherein the hose assembly of the spray hose assembly includes a flexible hose extending between the first end and the second end.

8. The spray hose assembly of claim 1, wherein the hose assembly of the spray hose assembly includes primary hose, a hot water hose, a cold water hose, and a three-way splitter valve, the three way splitter valve fluidly connecting the primary hose, the hot water hose, and the cold water hose.

9. The spray hose assembly of claim 8, wherein the fluid source valve is a cold water source valve fluidly connected to the cold water hose, and wherein the spray hose assembly further comprises a hot water source valve fluidly connected to the hot water source hose.

10. The spray hose assembly of claim 9, wherein the hot water source valve includes a male attachment end and a female attachment end for fluidly connecting the spray hose assembly to a hot water source of the washing machine appliance.

11. A washing machine appliance comprising:

a cabinet;

a tub positioned within the cabinet;

a basket rotatably mounted within the tub, the basket defining a wash chamber for receipt of articles for washing;

a supply line for fluidly connecting a spout of the washing machine appliance to a water source, the supply line comprising a supply line valve selectively adjusted between an open position and a closed position to provide a flow of fluid to the wash chamber; and a spray hose assembly comprising a hose assembly extending between a first end and a second end;

a water nozzle fluidly connected to the hose assembly at the first end; and a water source valve including an outlet fluidly connected to the hose assembly at the second end of the hose assembly, a first attachment end, and a second attachment end, the first attachment end fluidly connected to the water source and the second attachment end fluidly connected to the supply line such that the water source is configured to provide water to the hose assembly and the supply line, the second attachment end fluidly connected to the supply line at a location upstream of the supply line valve, wherein the hose assembly of the spray hose assembly further includes a primary hose, a hot water hose, a cold water hose, and a three-way splitter valve, the three way splitter valve fluidly connecting the primary hose, the hot water hose, and the cold water hose.

12. The washing machine appliance of claim 11, wherein the spray hose assembly further comprises a handle positioned at the first end of the hose assembly, the handle including the nozzle.

13. The washing machine appliance of claim 12, wherein the handle includes a magnet for removably attaching the handle to the cabinet of the washing machine appliance.

14. The washing machine appliance of claim 12, wherein the handle additionally includes an activation member, the activation member configured to selectively allow a flow of water from the hose assembly through the nozzle.

15. The washing machine appliance of claim 11, wherein the first attachment end of the water source valve is a male attachment end, and wherein the second attachment end of the water source valve is a female attachment end.

16. The washing machine appliance of claim 11, wherein the first attachment end and the second attachment end of the water source valve are each male attachment ends.

17. The washing machine appliance of claim 11, wherein the supply line valve is a cold water valve, wherein the supply line further comprises a hot water valve, wherein the fluid source valve is a cold water source valve fluidly connected to the cold water hose upstream of the cold water valve, and wherein the spray hose assembly further comprises a hot water source valve comprising an outlet fluidly connected to the hot water hose of the hose assembly, a first attachment end fluidly connected to a hot water source, and a second attachment end fluidly connected to the supply line at a location upstream of the hot water valve.

18. The washing machine appliance of claim 17, wherein the first attachment end of the hot water source valve is a male attachment end for fluidly connecting the spray hose assembly to the hot water source of the washing machine appliance.

19. The washing machine appliance of claim 11, wherein the supply line valve and fluid source valve of the spray hose assembly are each positioned outside the cabinet of the washing machine appliance.

* * * * *